US010422303B2

(12) United States Patent
Kishi et al.

(10) Patent No.: US 10,422,303 B2
(45) Date of Patent: Sep. 24, 2019

(54) VANE PUMP AND FUEL VAPOR LEAKAGE DETECTION DEVICE USING THE SAME

(71) Applicant: DENSO CORPORATION, Kariya, Aichi-pref. (JP)

(72) Inventors: Ryoyu Kishi, Novi, MI (US); Shigeru Hasegawa, Novi, MI (US); Tomohiro Itoh, Takai (JP); Kosei Takagi, Obu (JP)

(73) Assignee: DENSO CORPORATION, Kariya (JP)

( * ) Notice: Subject to any disclaimer, the term of this patent is extended or adjusted under 35 U.S.C. 154(b) by 475 days.

(21) Appl. No.: 14/852,165

(22) Filed: Sep. 11, 2015

(65) Prior Publication Data

US 2016/0102666 A1 Apr. 14, 2016

(30) Foreign Application Priority Data

Oct. 14, 2014 (JP) ..... 2014-209799

(51) Int. Cl.

| | |
|---|---|
| ***F04C 29/12*** | (2006.01) |
| ***F02M 25/08*** | (2006.01) |
| ***F04C 18/344*** | (2006.01) |

(52) U.S. Cl.

CPC ..... *F02M 25/089* (2013.01); *F02M 25/0809* (2013.01); *F04C 18/344* (2013.01); *F04C 29/12* (2013.01); *F04C 2240/30* (2013.01); *F04C 2250/101* (2013.01)

(58) Field of Classification Search

CPC ..... F04C 14/28; F04C 15/06; F04C 18/344; F04C 18/3441; F04C 28/28; F04C 29/12; F04C 2240/30; F04C 2250/10; F04C 2250/101; F04C 2250/102; F04C 2270/18; F04C 2270/185; F04C 15/062; F04C 18/3442; F04C 18/3443; F01C 21/0818

See application file for complete search history.

(56) References Cited

U.S. PATENT DOCUMENTS 4,599,057 A 7/1986 Baghuis
4,747,761 A * 5/1988 Yumiyama ..... F04C 29/068 181/272

(Continued)

FOREIGN PATENT DOCUMENTS

JP 57-110791 A 7/1982
JP 60-054788 U 4/1985

(Continued)

*Primary Examiner* — Bryan M Lettman
*Assistant Examiner* — Charles W Nichols

(57) ABSTRACT

A first plate portion covers one opening of a pump chamber of a tubular portion, and a second plate portion covers the other opening of the pump chamber along a center axis of the tubular portion. A hole forming portion is equipped to an outside of the tubular portion to form a connection hole. A length of the hole forming portion along the center axis is less than or equal to a length of the tubular portion along the center axis. A first imaginary line connects a center of an outer opening of the connection hole with a point on the center axis. The first imaginary line intersects perpendicularly with the center axis. A length of the connection hole in a direction perpendicular to both the first imaginary line and the center axis is greater than a length of the connection hole along the center axis.

9 Claims, 5 Drawing Sheets

(56) References Cited

U.S. PATENT DOCUMENTS

| | | | | | |
|---|---|---|---|---|---|
| 5,056,993 | A * | 10/1991 | Smith | F04C 15/06 | 138/178 |
| 5,144,802 | A * | 9/1992 | Ruzic | F01C 1/3442 | 418/148 |
| 6,503,064 | B1 * | 1/2003 | Croke | F01C 21/08 | 417/326 |
| 2011/0311385 | A1 * | 12/2011 | Kobayashi | F02M 25/0836 | 418/104 |
| 2013/0156564 | A1 | 6/2013 | Dong et al. | | |

FOREIGN PATENT DOCUMENTS

| | | | | |
|---|---|---|---|---|
| JP | 2003-214370 | A | | 7/2003 |
| JP | 2005-113869 | A | | 4/2005 |
| JP | 2012-188982 | A | | 10/2012 |
| JP | 2012188982 | A | * | 10/2012 |
| JP | 2013-096367 | A | | 5/2013 |

* cited by examiner

VANE PUMP AND FUEL VAPOR LEAKAGE DETECTION DEVICE USING THE SAME

CROSS REFERENCE TO RELATED APPLICATION

This application is based on reference Japanese Patent Application No. 2014-209799 filed on Oct. 14, 2014, the disclosure of which is incorporated herein by reference.

TECHNICAL FIELD

The present disclosure relates to a vane pump. The present disclosure further relates to a fuel vapor leakage detection device using the vane pump.

BACKGROUND

Conventionally, a fuel vapor processing system may recover fuel vapor, which is evaporated fuel from a fuel tank, and may supply the recovered fuel vapor into an intake air system of an internal combustion engine. A fuel vapor processing system may include a fuel vapor leakage detection device, which detects leakage of fuel vapor from a fuel tank and a canister. A fuel vapor leakage detection device may include a vane pump, a switching valve, a pressure sensor, and/or the like. The vane pump pressurizes or depressurizes an interior of a fuel tank and a canister. The switching valve switches between communication of the interior of the fuel tank and canister with the vane pump and communication of the interior of the fuel tank and canister with the atmosphere. The pressure sensor detects pressure in the fuel tank and the canister. Patent Document 1 may disclose a vane pump including a housing, a rotor, and a motor. The housing defines a pump chamber and has an intake hole and an exhaust hole, which communicate the pump chamber with the outside. The rotor is rotational in the pump chamber. The motor rotates the rotor. The intake hole and the exhaust hole are formed substantially at a center between an upper end surface and a lower end surface of the housing.

PATENT DOCUMENT 1

Publication of unexamined Japanese patent application No. 2012-002207

The housing of the vane pump described in Patent Document 1 includes a cam ring in a tubular shape and two plates. The two plates cover two openings, which are formed in both ends of the cam ring in a direction of the center axis. The vane pump described in Patent Document 1 may be employed in a fuel vapor leakage detection device. In this case, the intake hole may be communicated with a pressure detection passage in which pressure is detected with a pressure sensor. Therefore, an intake hole and a connection passage forming portion may be formed in a periphery of the cam ring. The connection passage forming portion may form a connection passage, which communicates the intake hole with the pressure detection passage. Grinding may be implemented on the two end surfaces of the cam ring, which form the two openings of the pump chamber, with high accuracy, in order to retain an airtight property of the pump chamber steadily. It may be assumable that the size of the connection passage forming portion is greater than the size of the cam ring in a direction of the center axis. In this case, when grinding is implemented on the two end surfaces of the cam ring, it may be required not to grind the connection passage forming portion simultaneously with grinding the two end surfaces of the cam ring. Consequently, manufacturing process for the grinding may be complicated. In addition, it may be hard to implement the grinding with high accuracy. To the contrary, it may be assumable to reduce the size of the connection passage forming portion in order to enable to grind the two end surfaces of the cam ring with high accuracy. In this case, the cross-sectional area of the connection passage may be reduced. Consequently, the configuration may increase a pipe friction caused by vapor, which flows through the connection passage. Consequently, the configuration may decrease intake efficiency of vapor.

SUMMARY

It is an object of the present disclosure to produce a vane pump configured to enhance an intake efficiency and an exhaust efficiency of fluid.

According to an aspect of the present disclosure, a vane pump comprises a pump chamber. The vane pump further comprises a housing having one communication hole, an other communication hole, which is different from the one communication hole, and a first connection hole. The one communication hole is configured to communicate with the pump chamber. The other communication hole is configured to communicate with the pump chamber. The first connection hole communicates an outside of the housing with one of the one communication hole and the other communication hole. The vane pump further comprises a rotor rotational in the pump chamber. The rotor includes a plurality of vanes configured to slide on an inner wall of the housing. The inner wall forms the pump chamber. The vane pump further comprises a motor configured to rotate the rotor. The housing includes a tubular portion, a first plate portion, a second plate portion, and a first connection hole forming portion. The first plate portion covers one opening of the pump chamber in a direction of a center axis of the tubular portion. The second plate portion covers an other opening of the pump chamber in the direction of the center axis. The first connection hole forming portion is equipped to a radially outside of the tubular portion to form the first connection hole. A length of the first connection hole forming portion in the direction of the center axis is less than or equal to a length of the tubular portion in the direction of the center axis. A first imaginary line connects a center of an outer opening of the first connection hole with a point on the center axis. The first imaginary line intersects perpendicularly with the center axis. A length of the first connection hole in a direction perpendicular to both the first imaginary line and the center axis is greater than a length of the first connection hole in the direction of the center axis.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Figure 1:
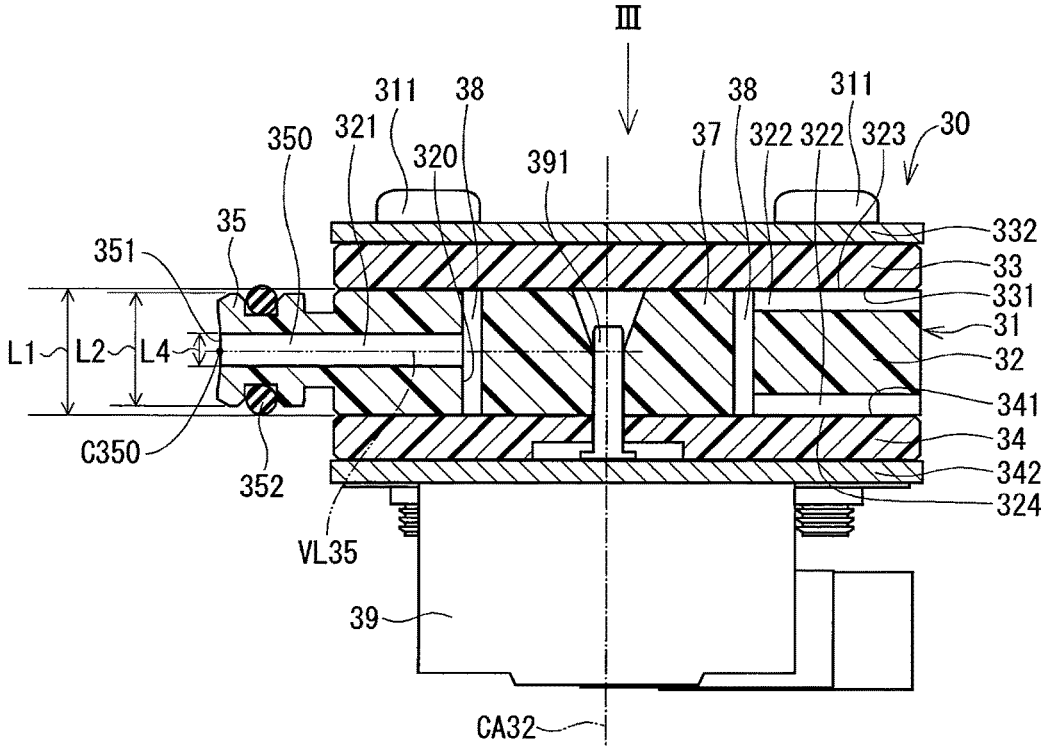
FIG. 1 is a sectional view showing a vane pump according to a first embodiment of the present disclosure.

As follows, multiple embodiments of the present disclosure will be described with reference to drawings.

First Embodiment

A vane pump according to a first embodiment of the present disclosure will be described with reference to FIGS. 1 to 5. To begin with, a fuel vapor leakage detection device 5 using a vane pump 30 according to the first embodiment will be described with reference to FIG. 2. The fuel vapor leakage detection device 5 is included in a fuel vapor processing system 1.

The fuel vapor processing system 1 includes a fuel tank 10, a canister 12, a purge valve 14, a fuel vapor leakage detection device 5, and/or the like. In the fuel vapor processing system 1, the canister 12 recovers vapor fuel created in the fuel tank 10. The canister 12 purges recovered fuel vapor into an intake passage 161. The intake passage 161 is formed in an intake pipe 16, which is connected to an engine 9.

The fuel tank 10 stores fuel to be supplied to the engine 9. The fuel tank 10 is connected with the canister 12 through a communication pipe 11. The communication pipe 11 forms a communication passage 111, which communicates the interior of the fuel tank 10 with the interior of the canister 12.

The canister 12 includes a canister absorbing material 121, which recovers vapor fuel created in the fuel tank 10. The canister 12 is connected with the intake pipe 16 through a purge pipe 13, which forms a purge passage 131.

The purge pipe 13 is equipped with the purge valve 14. The purge valve 14 is, for example, a solenoid valve. Vapor fuel is purged from the canister 12 to the intake passage 161 on the downstream side of a throttle valve 18. A quantity of this vapor fuel is controlled by manipulating the opening of the purge valve 14.

The fuel vapor leakage detection device 5 includes a canister connecting pipe 21, the vane pump 30, a pressure sensor 24, a pressure detection pipe 25, an atmospheric passage pipe 28, a switching valve 22, a switching valve bypass pipe 26, a reference orifice 27, an air filter 23, an ECU 8, and/or the like. The pressure sensor 24 may function as a pressure detection unit. The fuel vapor leakage detection device 5 is configured to cause the vane pump 30 to depressurize the interior of the fuel tank 10 and the canister 12 thereby to detect leakage of fuel vapor from the fuel tank 10 and the canister 12.

The canister connecting pipe 21 forms a canister connection passage 211, which communicates the switching valve 22 with the canister 12. The canister connecting pipe 21 is connected with the switching valve bypass pipe 26. The switching valve bypass pipe 26 forms a switching valve bypass passage 261, which communicates the canister connection passage 211 with a pressure detection passage 251 without passing through the switching valve 22.

The vane pump 30 is connected with the pressure detection pipe 25 and the atmospheric passage pipe 28. The vane pump 30 is electrically connected with the ECU 8. The vane pump 30 draws vapor from the interior of the fuel tank 10 and the interior of the canister 12 according to a signal sent from the ECU 8. The configuration of the vane pump 30 will be described later in detail.

The pressure detection pipe 25 connects the vane pump 30 with the switching valve 22. The pressure detection pipe 25 is connected with the switching valve bypass pipe 26 at an intermediate portion. The pressure detection pipe 25 is equipped with the pressure sensor 24, which detects pressure in the pressure detection passage 251.

The atmospheric passage pipe 28 connects the air filter 23 with both the vane pump 30 and the switching valve 22. The atmospheric passage pipe 28 forms an atmospheric passage 281. The vane pump 30 draws vapor in the fuel tank 10 and/or vapor in the canister 12, and the drawn vapor flows through the atmospheric passage 281 toward the air filter 23. When fuel vapor recovered by the canister 12 is purged into the intake pipe 16, air drawn into the canister 12 flows through the atmospheric passage 281 toward the switching valve 22.

The switching valve 22 is, for example, an electromagnetic valve (solenoid valve). The switching valve 22 is electrically connected with the ECU 8. The switching valve 22 switches communication of the canister connection passage 211 with the atmospheric passage 281 or the pressure detection passage 251 according to an electric power supplied from the ECU 8 to a coil 221.

The reference orifice 27 is equipped in the switching valve bypass pipe 26. The reference orifice 27 has a hole in a size, which corresponds to an upper limit of an allowable quantity of leakage of air including vapor fuel from the fuel tank 10.

Figure 2:
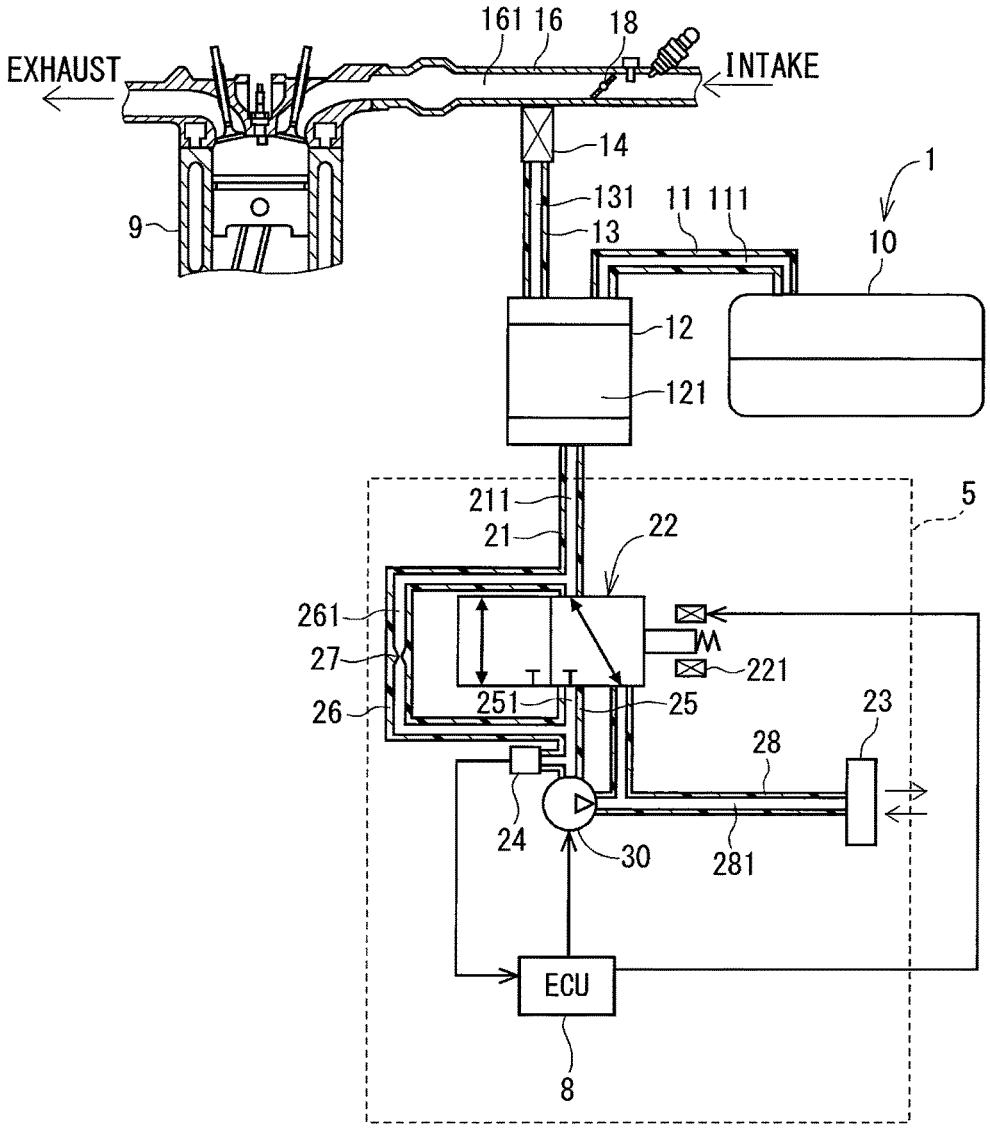
FIG. 2 is a schematic diagram showing a fuel vapor leakage detection device employing the vane pump according to the first embodiment of the present disclosure.
Figure 3:
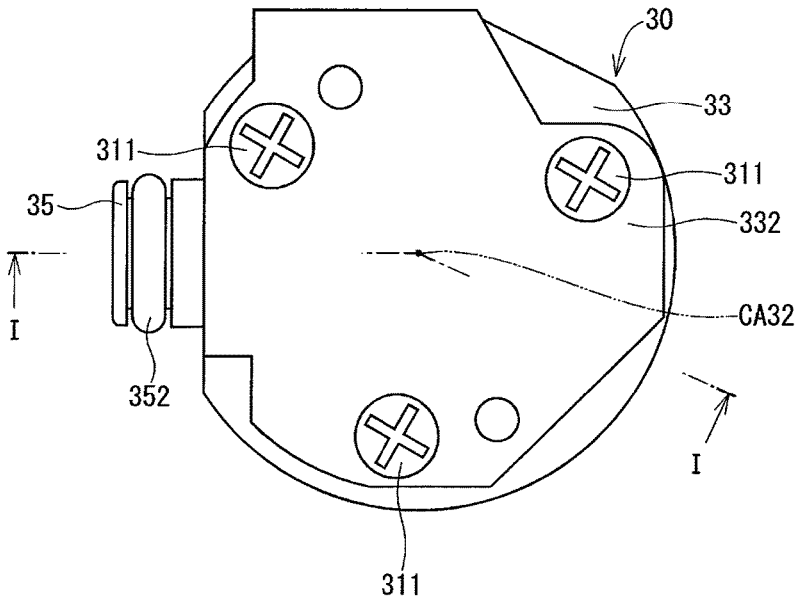
FIG. 3 is a view showing an appearance of the vane pump according to the first embodiment of the present disclosure.
Figure 4:
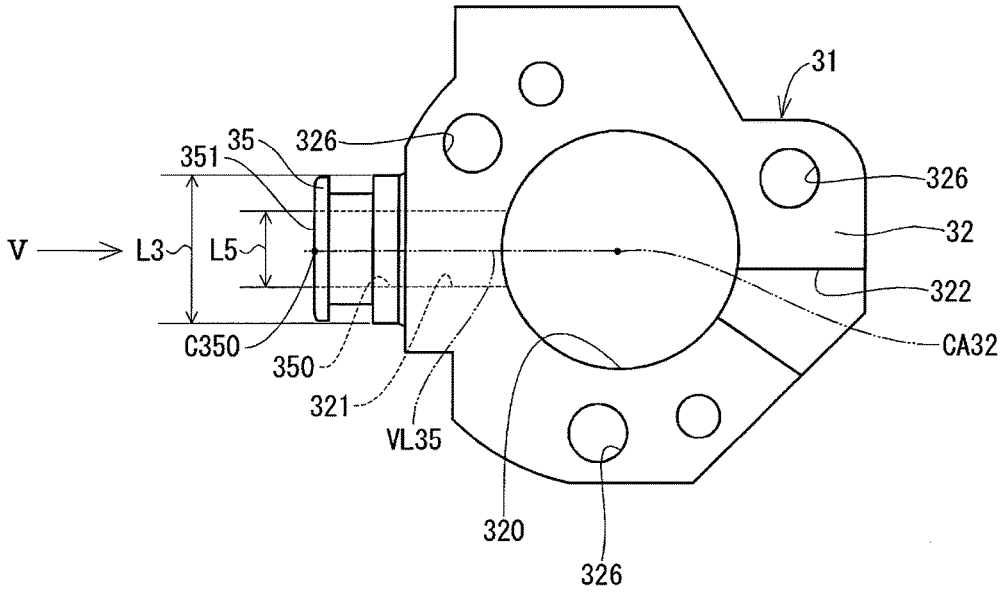
FIG. 4 is a view showing an appearance of a cam ring of the vane pump according to the first embodiment of the present disclosure.

The air filter 23 is connected to one end of the atmospheric passage pipe 28 on the side of the atmosphere. The air filter 23 captures foreign matters contained in air drawn from the atmosphere into the fuel vapor processing system 1. The arrows in FIG. 2 represent the flow of air.

The ECU 8 includes a microcomputer including a CPU, a RAM, a ROM, and/or the like. The CPU may function as a computation unit. The RAM and/or the ROM may function as a storage unit. The ECU 8 is electrically connected with the pressure sensor 24, the vane pump 30, and the coil 221. The pressure sensor 24 detects pressure in the pressure detection passage 251 and sends a detection signal, which corresponds to the detected pressure. The ECU 8 receives the detection signal from the pressure detection passage 251. The ECU 8 sends a signal to control a driving power of the vane pump 30. The ECU 8 controls an electric power supplied to the coil 221.

As follows, the configuration of the vane pump 30 will be described in detail.

The vane pump 30 is actuated with a brushless direct-current motor. The vane pump 30 includes a housing 31, a rotor 37, a motor 39, and/or the like.

The housing 31 includes a cam ring 32, a first plate 33, a second plate 34, a first connection hole forming portion 35, and/or the like. The cam ring 32 may function as a tubular portion. The first plate 33 may function as a first plate portion. The second plate 34 may function as a second plate portion. In the first embodiment, the cam ring 32 and the first connection hole forming portion 35 are formed integrally with each other.

The cam ring 32 is a tubular portion formed of resin. The cam ring 32 includes a pump chamber 320, an intake hole 321, and an exhaust hole 322. The intake hole 321 may function as one communication hole. The exhaust hole 322 may function as the other communication hole.

The pump chamber 320 is formed to extend through the cam ring 32 in a direction of the center axis CA32 of the cam ring 32. The pump chamber 320 accommodates the rotor 37 rotationally. The rotor 37 will be described later. The intake hole 321 is formed in a direction perpendicular to the center axis CA32. The intake hole 321 is configured to communicate the pump chamber 320 with an exterior of the cam ring 32. The intake hole 321 is formed substantially at the center between an end surface 323 of the cam ring 32 on the side of the first plate 33 and the end surface 324 of the cam ring 32 on the side of the second plate 34. The present configuration may enable to reduce oscillation of the rotor 37, which is caused by pressure difference of vapor drawn through the intake hole 321 into the pump chamber 320. Two exhaust holes 322 are formed substantially on the opposite side of the center axis CA32 from the intake hole 321. The exhaust holes 322 are formed in a direction perpendicular to the center axis CA32. The exhaust holes 322 are configured to communicate the pump chamber 320 with the exterior of the cam ring 32. The exhaust holes 322 are formed separately from the intake hole 321. The exhaust holes 322 are formed with two grooves. The two grooves are formed with an end of the cam ring 32 on the side of the first plate 33 and an end of the cam ring 32 on the side of the second plate 34.

The cam ring 32 has multiple bolt holes 326, which extend through the cam ring 32 in the direction of the center axis CA32. In the first embodiment, three bolt holes 326 are formed. A bolt 311 is inserted in each of the bolt holes 326 to screw the first plate 33, the cam ring 32, and the second plate 34 with the motor 39.

The first plate 33 is formed of resin. The first plate 33 is equipped on the opposite side of the cam ring 32 from the motor 39. The first plate 33 is equipped to cover an opening of the pump chamber 320 on the opposite side of the motor 39. The first plate 33 has an end surface 331 on the side of the cam ring 32. The end surface 331 is in contact with the end surface 323 of the cam ring 32 on the side of the first plate 33. A protection plate 332 is equipped to the first plate 33 on the opposite side of the cam ring 32. The protection plate 332 protects the first plate 33 from breakage due to a screwing force of the bolt 311, when the first plate 33 and the cam ring 32 are screwed together with the bolt 311.

The second plate 34 is formed of resin. The second plate 34 is equipped between the cam ring 32 and the motor 39. The second plate 34 is equipped to cover an opening of the pump chamber 320 on the side of the motor 39. The second plate 34 has an end surface 341 on the side of the cam ring 32. The end surface 341 is in contact with an end surface 324 of the cam ring 32 on the side of the second plate 34. A protection plate 342 is equipped to the second plate 34 on the side of the motor 39. The protection plate 342 protects the second plate 34 from breakage due to a screwing force of the bolt 311, when the second plate 34 and the cam ring 32 are screwed together with the bolt 311.

Figure 5:
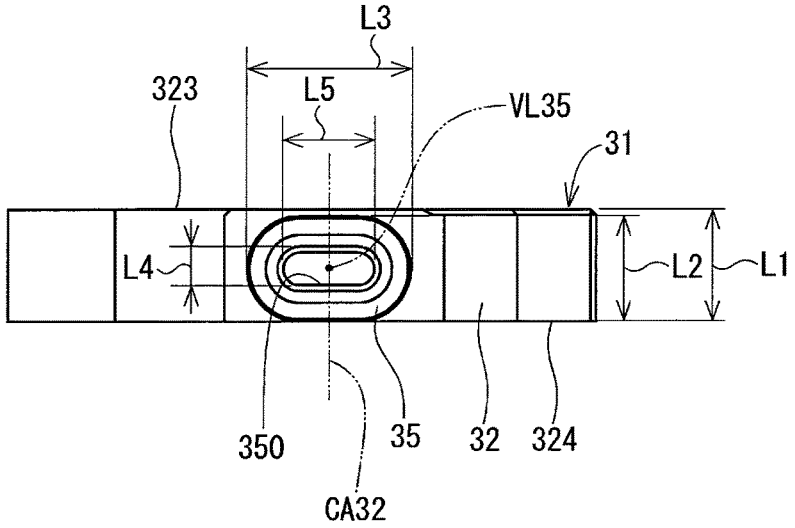
FIG. 5 is a view when viewed along the arrow V in FIG. 4.

The first connection hole forming portion 35 is equipped to the cam ring 32 on the radially outside of the portion, which forms the intake hole 321. As shown in FIG. 5, the first connection hole forming portion 35 has a cross section in a round rectangular shape. The first connection hole forming portion 35 has a first connection hole 350, which extends through the first connection hole forming portion 35 in a direction perpendicular to the center axis CA32. The first connection hole 350 is formed to have a cross section in a round rectangular shape. The first connection hole 350 communicates with the intake hole 321. The first connection hole forming portion 35 is equipped with a seal member 352 on the radially outside. The first connection hole forming portion 35 is connected with the pressure detection pipe 25. In the present configuration, the intake hole 321 communicates with the pressure detection passage 251 through the first connection hole 350.

As shown in FIG. 5, the first connection hole forming portion 35 has a length L2 in the direction of the center axis CA32. The cam ring 32 has a length L1 in the direction of the center axis CA32. The first connection hole forming portion 35 is formed such that the length L2 of the first connection hole forming portion 35 is less than or equal to the length L1 of the cam ring 32. A first imaginary line VL35 connects a center C350 of an outer opening 351 of the first connection hole 350 with a point on the center axis CA32. The first imaginary line VL35 intersects perpendicularly with the center axis CA32. The first connection hole forming portion 35 has a length L3 in a direction perpendicular to both the first imaginary line VL35 and the center axis CA32. The first connection hole forming portion 35 is formed such that the length L3 is greater than the length L2.

As shown in FIG. 5, the first connection hole 350 has a length L5 in a direction perpendicular to both the first imaginary line VL35 and the center axis CA32. The first connection hole 350 has a length L4 in the direction of the center axis CA32. The first connection hole 350 is formed such that the length L5 is greater than the length L4.

The rotor 37 rotates in a forward direction integrally with a shaft 391 of the motor 39 such that the rotor 37 draws vapor in the fuel tank 10 and the canister 12. Vanes 38 are equipped on the radially outside of the rotor 37 at regular intervals. The vanes 38 are inserted in grooves of the rotor 37. The grooves are formed on the radially outside of the rotor 37. The vanes 38 are configured to move radially outward when the rotor 37 rotates. The vanes 38 have end surfaces on the radially outside, and the end surfaces are slidable on an inner wall of the cam ring 32. The inner wall of the cam ring 32 forms the pump chamber 320.

The motor 39 includes the shaft 391, which is projected toward the pump chamber 320. The motor 39 is supplied with an electric power from an external device. The motor 39 generates a driving torque to rotate the shaft 391.

Subsequently, an operation of the fuel vapor leakage detection device 5 according to the first embodiment will be described.

When a predetermined time period elapses after the engine 9 of the vehicle is stopped, the ECU 8 is activated by a (not shown) soak timer. To begin with, detection of the atmospheric pressure is implemented in order to correct an error caused according to the altitude at which the vehicle is parked. When an electric power is not supplied to the coil 221, the atmospheric passage 281 is communicated with the canister connection passage 211 through the switching valve 22. The canister connection passage 211 is communicated with the pressure detection passage 251 through the switching valve bypass passage 261. In the present state, the pressure detection passage 251 is communicated with the atmosphere. Therefore, the pressure sensor 24, which is equipped to the pressure detection pipe 25, is enabled to detect the atmospheric pressure. When detection of the atmospheric pressure is completed, the ECU 8 calculates the altitude of the place, at which the vehicle is parked, according to the detected pressure.

Subsequently, electric power is supplied to the vane pump 30 thereby to depressurize the pressure detection passage 251. When the pressure detection passage 251 is depressurized, atmospheric air flows through the atmospheric passage 281, the switching valve 22, the canister connection passage 211, and the switching valve bypass passage 261 into the pressure detection passage 251. The air flowing into the pressure detection passage 251 is throttled by the reference orifice 27. Therefore, pressure in the pressure detection passage 251 decreases. Pressure in the pressure detection passage 251 decreases to a predetermined pressure, which corresponds to the opening area of the reference orifice 27, and subsequently, the pressure becomes constant. The detected pressure in the pressure detection passage 251 is stored as a reference pressure.

When the reference pressure is detected, the coil 221 of the switching valve 22 is energized. Thus, the switching valve 22 blocks the canister connection passage 211 from the atmospheric passage 281, and communicates the canister connection passage 211 with the pressure detection passage 251. When the canister connection passage 211 is communicated with the pressure detection passage 251, the pressure in the pressure detection passage 251 becomes the same as the pressure in both the fuel tank 10 and the canister 12.

When the canister connection passage 211 is communicated with the pressure detection passage 251, the vane pump 30 depressurizes the interior of both the fuel tank 10 and the canister 12.

When the vane pump 30 continues operation to decrease the pressure in the pressure detection passage 251, i.e., pressure in both the fuel tank 10 and the canister 12 to less than the reference pressure, which is detected before, determination is made that leakage of vapor including the fuel vapor from the fuel tank 10 or the canister 12 is less than or equal to an allowable quantity. That is, when pressure inside the fuel tank 10 and the canister 12 decreases to less than the reference pressure, it is assumed as follows. First, air does not intrude from the outside of the canister 12 or the fuel tank 10 into the canister 12 or the fuel tank 10. Alternatively, a quantity of air intruding from the outside into the canister 12 or the fuel tank 10 is equal to or less than a quantity of air which can pass through the reference orifice 27. Therefore, it is determined that the airtight property of the fuel tank 10 and the canister 12 is sufficiently secured.

To the contrary, when pressure inside the fuel tank 10 and the canister 12 does not decrease to the reference pressure, it is determined that leakage of vapor, which includes fuel vapor from the fuel tank 10 or the canister 12, exceeds the allowable quantity. That is, when pressure inside the fuel tank 10 and the canister 12 does not decrease to the reference pressure, it is assumable that air intrudes from the outside into the fuel tank 10 and the canister 12 due to depressurization of the fuel tank 10 and the canister 12. Therefore, it is determined that the airtight property of the fuel tank 10 and the canister 12 is not sufficiently secured.

When determination of the airtightness of the fuel tank 10 and the canister 12 is completed, electricity supply to the switching valve 22 is terminated. In addition, the reference pressure again is confirmed. Subsequently, electricity supply to the vane pump 30 is terminated. After the ECU 8 detects the pressure in the pressure detection passage 251 to recover to the atmospheric pressure, the ECU 8 terminates the operation of the pressure sensor 24. Thus, the ECU 8 terminates the fuel vapor leakage detection processing.

In the vane pump 30 according to the first embodiment, the first connection hole forming portion 35 is formed such that the length L2 in the direction of the center axis CA32 is equal to or less than the length L1 of the cam ring 32 in the direction of the center axis CA32. The present configuration may enable to grind the end surfaces 323 and 324 of the cam ring 32 with high accuracy, without interference with the first connection hole forming portion 35 in a manufacturing process of the vane pump 30. Therefore, the present configuration may enable to reduce the gap between the cam ring 32 and the first plate 33 and to reduce the gap between the cam ring 32 and the second plate 34, thereby to steadily secure the airtight property of the pump chamber 320.

In addition, the first connection hole 350 of the first connection hole forming portion 35 is formed in the following manner. The first connection hole 350 has the length L5 in the direction perpendicular to both the first imaginary line VL35 and the center axis CA32. The first connection hole 350 has the length L4 in the direction of the center axis CA32. The length L5 is greater than the length L4. Furthermore, the first connection hole forming portion 35 is formed in the following manner. The first connection hole forming portion 35 has the length L3 in the direction perpendicular to both the first imaginary line VL35 and the center axis CA32. The length L3 is greater than the length L2. As described above, the first connection hole forming portion 35 is formed such that the length L2 in the direction of the center axis CA32 is equal to or less than the length L1 of the cam ring 32 in the direction of the center axis CA32. The present configuration, in which the length L3 is greater than the length L2, may enable to enlarge the cross-sectional area of the first connection hole 350 of the first connection hole forming portion 35, relatively. The present configuration may enable to reduce a pipe friction caused in air flowing from the outside of the pump chamber 320 through the first connection hole 350 into the pump chamber 320, relatively. As described above, in the vane pump 30 according to the first embodiment, both the end surfaces 323 and 324 of the cam ring 32, which form the two openings of the pump chamber 320, are ground with high accuracy, thereby to secure the airtight property of the pump chamber 320 steadily. In addition, the pipe friction in the flow of air from the outside into the pump chamber 320 is reduced. In this way, the present configuration may facilitate fluid to flow into the pump chamber 320. Thus, the present configuration may enhance intake efficiency of air.

Second Embodiment

Subsequently, a vane pump according to a second embodiment of the present disclosure will be described with reference to FIG. 6. The second embodiment differs from the first embodiment in that the second connection hole forming portion is equipped.

Figure 6:
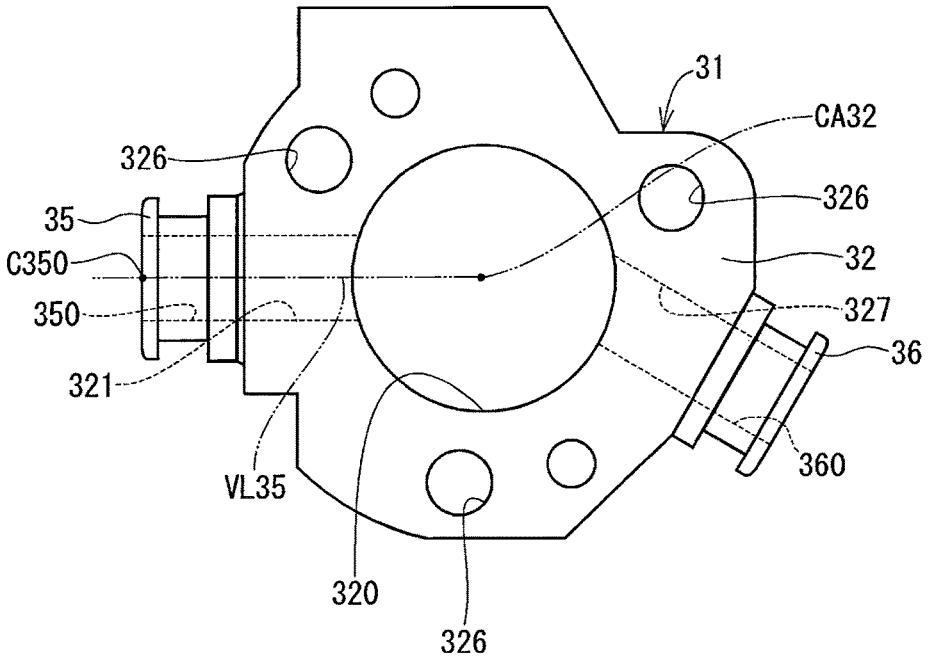
FIG. 6 is a view showing an appearance of a cam ring of a vane pump according to a second embodiment of the present disclosure.

FIG. 6 shows an appearance of the cam ring 32 of the vane pump according to the second embodiment. The cam ring 32 includes the pump chamber 320, the intake hole 321, and an exhaust hole 327. The exhaust hole 327 may function as the other communication hole. A singular exhaust hole 327 is formed substantially on the opposite side of the center axis CA32 from the intake hole 321. The exhaust hole 327 is formed in a direction perpendicular to the center axis CA32. The exhaust hole 327 is configured to communicate the pump chamber 320 with an exterior of the cam ring 32. The exhaust hole 327 is formed substantially at the center between the end surface 323 and the end surface 324. The present configuration may enable to reduce oscillation of the rotor 37, which is caused by pressure difference of vapor exhausted from the pump chamber 320 through the exhaust hole 327.

The second connection hole forming portion 36 is equipped to the cam ring 32 on the radially outside of the portion, which forms the exhaust hole 327. The second connection hole forming portion 36 has a cross section in a round rectangular shape. The second connection hole forming portion 36 has a second connection hole 360, which extends through the second connection hole forming portion 36 in a direction perpendicular to the center axis CA32. The second connection hole 360 communicates with the exhaust hole 327. The second connection hole forming portion 36 is connected with the atmospheric passage pipe 28. Thus, the exhaust hole 327 communicates with the atmospheric passage 281 through the second connection hole 360.

The housing 31 of the vane pump according to the second embodiment includes the second connection hole forming portion 36, in addition to the first connection hole forming portion 35, which is connected to the pressure detection pipe 25. The second connection hole forming portion 36 is connected to the atmospheric passage pipe 28. The present configuration may enable the vane pump according to the second embodiment to be equipped between the pressure detection pipe 25 and the atmospheric passage pipe 28. Therefore, the configuration of the second embodiment may enable to exhaust air, which is from the vane pump, efficiently through the air filter 23 to the atmosphere. In addition, the configuration of the second embodiment may produce substantially the same effect as that of the first embodiment.

Third Embodiment

Subsequently, a vane pump according to the third embodiment of the present disclosure will be described with reference to FIG. 7. The third embodiment differs from the first embodiment in the position at which the exhaust hole is formed.

Figure 7:
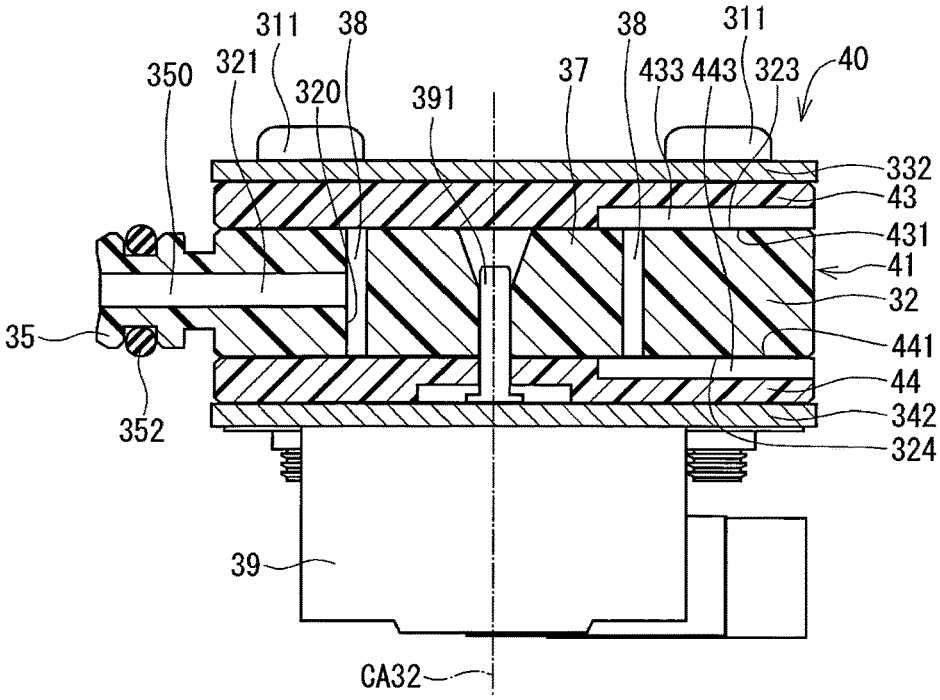
FIG. 7 is a sectional view showing an appearance of a vane pump according to a third embodiment of the present disclosure.

FIG. 7 is a sectional view showing a vane pump 40 according to the third embodiment. A housing 41 of the vane pump 40 includes a first plate 43 and a second plate 44. The first plate 43 may function as a first plate portion. The second plate 44 may function as a second plate portion.

The first plate 43 is formed is resin. The first plate 43 is equipped to cover an opening of the pump chamber 320. The opening is located on the opposite of the pump chamber 320 from the motor 39. An end surface 431 of the first plate 43 is in contact with the end surface 323 of the cam ring 32. The end surface 323 is located on the side of the first plate 43. In addition, a groove 433 is formed in the first plate 43 on the side of the cam ring 32. The groove 433 is located substantially on the opposite side of the center axis CA32 from the intake hole 321. The groove 433 and the end surface 323 of the cam ring 32 form an exhaust hole, which communicates the pump chamber 320 with the outside.

The second plate 44 is formed of resin. The second plate 44 is equipped to cover an opening of the pump chamber 320 on the side of the motor 39. An end surface 441 of the second plate 44 is in contact with the end surface 324 of the cam ring 32 on the side of the second plate 44. A groove 443 is formed in the second plate 44 on the side of the cam ring 32. The groove 443 is located substantially on the opposite side of the center axis CA32 from the intake hole 321. The groove 443 and the end surface 324 of the cam ring 32 form an exhaust hole, which communicates the pump chamber 320 with the outside.

In the vane pump 40 according to the third embodiment, the exhaust holes communicate the pump chamber 320 with the outside to exhaust vapor in the pump chamber 320. The exhaust holes are formed in the first plate 43 and the second plate 44, respectively. The present configuration of the third embodiment may enable to produce substantially the same effect as that of the first embodiment.

Other Embodiment (a) In the above-described embodiments, the vane pump draws vapor in the fuel tank and the canister. It is noted that, the vane pump may pressurize vapor in the fuel tank and the canister. That is, the motor of the vane pump according to the present disclosure may be configured to rotate the rotor and the vane in either the forward direction or the reverse direction.

Figure 8:
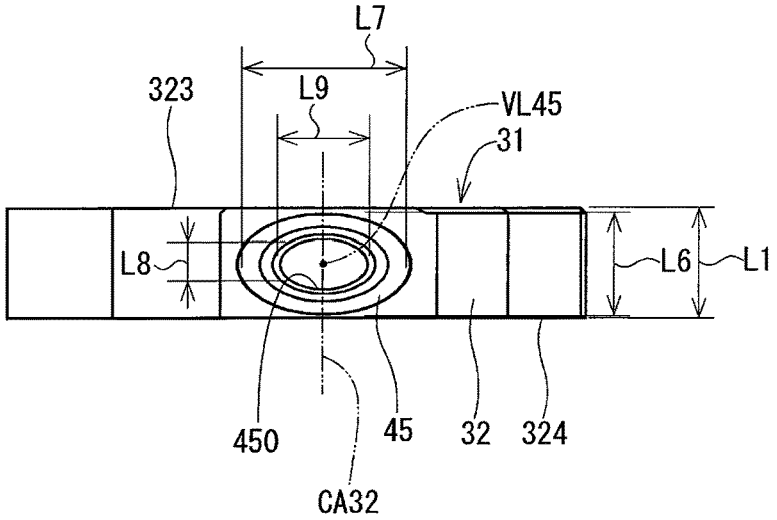
FIG. 8 is a view showing an appearance of a first connection hole forming portion of a vane pump according to another embodiment of the present disclosure.

(b) In the first embodiment, the first connection hole forming portion has the cross section perpendicular to the first imaginary line, and the cross section is in the round rectangular shape. In addition, according to the second embodiment, the second connection hole forming portion has the sectional shape in the round rectangular shape. It is noted that, the sectional shape of the first connection hole forming portion and the sectional shape of the second connection hole forming portion are not limited to the above-described examples. As shown in FIG. 8, the sectional shape of the first connection hole forming portion and/or the sectional shape of the second connection hole forming portion may be in an oval shape. In this case, the first connection hole forming portion 45 may be formed such that the length L6 in the direction of the center axis CA32 is less than or equal to the length L1 of the cam ring 32 in the direction of the center axis CA32. A first imaginary line VL45 connects the center of the outer opening of a first connection hole 450 with a point on the center axis CA32. The first connection hole 450 of the first connection hole forming portion 45 has a length L9 in a direction perpendicular to both the first imaginary line VL45 and the center axis CA32. The first connection hole 450 has a length L8 in the direction of the center axis CA32. The length L9 may be greater than the length L8. In addition, the first connection hole forming portion 45 may be formed such that the length L7, which is in the direction perpendicular to both the first imaginary line VL45 and the center axis CA32, is greater than the length L6.

(c) In the above-described embodiments, the intake hole is exemplified as the one communication hole, and the exhaust hole is exemplified as the other communication hole. In addition, the first connection hole of the first connection hole forming portion communicates with the intake hole. It is noted that, the first connection hole may communicate with the exhaust hole.

The vane pump of the present disclosure includes the housing, the rotor, and the motor. The housing has a pump chamber, the one communication hole, the other communication hole, and the first connection hole. The one communication hole is configured to communicate with the pump chamber. The other communication hole is different from the one communication hole and is configured to communicate with the pump chamber. The first connection hole communicates with one of the one communication hole and the other communication hole. The housing is formed with the tubular portion, the first plate portion, the second plate portion, and the first connection hole forming portion. The first plate portion covers the one opening of pump chamber in the direction of the center axis of the tubular portion. The second plate portion covers the other opening of the pump chamber in the direction of the center axis. The first connection hole forming portion is equipped on the radially outside of the tubular portion to form the first connection hole. In the vane pump of the present disclosure, the length of the first connection hole forming portion in the direction of the center axis is less than or equal to the length of the tubular portion in the direction of the center axis. The first imaginary line connects the center of the outer opening of the first connection hole with the point on the center axis. The first imaginary line intersects perpendicularly with the center axis. The length of the first connection hole in the direction perpendicular to both the first imaginary line and the center axis is greater than the length of the first connection hole in the direction of the center axis.

In the vane pump of the present disclosure, the housing has the pump chamber, which rotatably accommodates the rotor, and the first connection hole. The first connection hole communicates the outside with one of the one communication hole and the other communication hole, which is configured to communicate the pump chamber with the outside. The first connection hole is formed with the first connection hole forming portion of the housing. The first connection hole forming portion is formed such that the length of the first connection hole forming portion in the direction of the center axis is equal to or less than the length of the tubular portion in the direction of the center axis. The present configuration may enable to grind the two end surfaces of the cam ring, which form the two openings of the pump chamber, respectively, with high accuracy, without interference with the first connection hole forming portion.

In addition, the first imaginary line connects the center of the outer opening of the first connection hole with the point on the center axis. The first imaginary line intersects perpendicularly with the center axis. The first connection hole is formed such that the length of the first connection hole in the direction perpendicular to both the first imaginary line and the center axis is greater than the length of the first connection hole in the direction of the center axis. A configuration may be employable where the length of the first connection hole forming portion in the direction of the center axis is set to less than or equal to the length of the tubular portion in the direction of the center axis. Even in this configuration, the cross-sectional area of the first connection hole may have a relatively large area, by setting the length of the first connection hole in the direction perpendicular to both the first imaginary line and the center axis to greater than the length of the first connection hole in the direction of the center axis. Therefore, the configuration may enable to reduce pipe friction caused in fluid flow between the pump chamber and the outside through the first connection hole. As described above, the vane pump of the present disclosure may enable to grind the two end surfaces of the cam ring, which forms the two openings of the pump chamber, with high accuracy, thereby to reduce the gap formed between the cam ring and the two plate portions. In addition, the configuration may enable to reduce pipe friction caused in fluid flow in the pump chamber thereby to facilitate fluid to flow into the pump chamber or to flow from the pump chamber. The present configuration may enable to enhance an intake efficiency and an exhaust efficiency of fluid.

The above processings such as calculations and determinations may be performed by any one or any combinations of software, an electric circuit, a mechanical device, and the like. The software may be stored in a storage medium, and may be transmitted via a transmission device such as a network device. The electric circuit may be an integrated circuit, and may be a discrete circuit such as a hardware logic configured with electric or electronic elements or the like. The elements producing the above processings may be discrete elements and may be partially or entirely integrated.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A vane pump comprising:

a housing that has a pump chamber;

a rotor rotatably housed in the pump chamber, the rotor including a plurality of vanes configured to slide along an inner wall of the housing, the inner wall forming the pump chamber; and a motor configured to rotate the rotor, wherein the housing includes a tubular portion that defines the pump chamber therein and includes a first surface and a second surface facing each other along a center axis of the tubular portion, the pump chamber including a first opening on the first surface and a second opening on the second surface, a first plate portion that is in contact with the first surface and covers the first opening of the pump chamber, and a second plate portion that is in contact with the second surface and covers the second opening of the pump chamber, wherein the tubular portion, the first plate portion, and the second plate portion are separately formed from each other, the tubular portion includes a first communication hole that is in communication with the pump chamber, a second communication hole that is defined separately from the first communication hole and is in communication with the pump chamber, and a connection portion that is formed integrally with the tubular portion, protrudes from a circumferential surface of the tubular portion along a radial direction of the tubular portion, and is configured to be connected to an external connection member, the connection portion defines a connection hole therein to be in communication with one of the first communication hole and the second communication hole, the connection portion entirely surrounds the connection hole, a length of the connection portion along the center axis is less than or equal to a length between the first surface and the second surface of the tubular portion along the center axis, a first imaginary line connects a center of an outer opening of the connection hole with a point on the center axis, the first imaginary line intersects perpendicularly with the center axis, and a length of the connection hole along a direction perpendicular to both the first imaginary line and the center axis is greater than a length of the connection hole along the center axis.

2. The vane pump according to claim 1, wherein a length of the connection portion along a direction perpendicular to both the first imaginary line and the center axis is greater than the length of the connection portion along the center axis.

3. The vane pump according to claim 1, wherein the connection portion has a sectional shape perpendicular to the first imaginary line, and the sectional shape is in an oval shape or in a round rectangular shape.

4. The vane pump according to claim 1, wherein the motor is configured to rotate in both a forward direction and an reverse direction.

5. A fuel vapor leakage detection device configured to detect leakage of fuel vapor from a fuel tank, the fuel vapor leakage detection device comprising:

the vane pump according to claim 1;

a pressure detection unit configured to detect pressure in the fuel tank; and a controller, wherein the controller is configured to compare pressure in the fuel tank with a reference pressure to detect leakage of fuel vapor from the fuel tank when the vane pump depressurizes or pressurizes an interior of the fuel tank.

6. The vane pump according to claim 1, wherein the first connection member is offset from both the first plate and the second plate in the radial direction and is not overlapped therewith in a direction along the center axis.

7. The vane pump according to claim 1, wherein the first surface and the second surface of the tubular portion are grinded.

8. The vane pump according to claim 1, further comprising a bolt that is inserted into the tubular portion, the first plate portion, and the second plate portion, wherein the tubular portion, the first plate portion, and the second plate portion are fixed to each other by the bolt.

9. The vane pump according to claim 1, wherein the tubular portion is a cam ring having a flat disk shape.

* * * * *